US007314998B2

(12) United States Patent
Amato et al.

(10) Patent No.: US 7,314,998 B2
(45) Date of Patent: Jan. 1, 2008

(54) COAXIAL CABLE JUMPER DEVICE

(76) Inventors: Alan John Amato, 745 S. Brooksvale Rd., Cheshire, CT (US) 06410; Jesus Mercado, 346 Via de la Santa Cruz Ct., Rio Rico, AZ (US) 85648; Timothy D. Cooke, 220 Peach St., Chatham, VA (US) 24531; Larry Carroll, 129 Quail Ridge Dr., Altavista, VA (US) 24517

( * ) Notice: Subject to any disclaimer, the term of this patent is extended or adjusted under 35 U.S.C. 154(b) by 0 days.

(21) Appl. No.: 11/350,861

(22) Filed: Feb. 10, 2006

(65) Prior Publication Data

US 2007/0187133 A1 Aug. 16, 2007

(51) Int. Cl.
*H01R 4/00* (2006.01)

(52) U.S. Cl. ..... 174/84 R; 174/88 R; 174/88 C

(58) Field of Classification Search ..... 174/36, 174/102 R, 103, 28
See application file for complete search history.

(56) References Cited

U.S. PATENT DOCUMENTS 3,296,365 A * 1/1967 Basile ..... 174/117 FF
3,878,341 A * 4/1975 Balde ..... 307/113
4,508,415 A * 4/1985 Bunnell ..... 439/497
4,640,569 A * 2/1987 Dola et al. ..... 439/461
4,664,464 A * 5/1987 Hutter et al. ..... 439/460
4,772,212 A * 9/1988 Sotolongo ..... 439/98
5,068,632 A * 11/1991 Champeau ..... 333/238
5,259,792 A * 11/1993 Beck et al. ..... 439/607
5,349,133 A * 9/1994 Rogers ..... 174/36
5,501,615 A * 3/1996 Inaba et al. ..... 439/578
5,965,847 A * 10/1999 Tanaka et al. ..... 174/84 R
6,384,337 B1 * 5/2002 Drum ..... 174/102 R
6,464,516 B2 * 10/2002 Baldock ..... 439/120
6,545,223 B2 * 4/2003 Baldock ..... 174/115
6,646,207 B1 * 11/2003 Featherstone, III ..... 174/117 F
6,648,690 B2 * 11/2003 Saito et al. ..... 439/610

OTHER PUBLICATIONS

Print out from Talco Electronic website (http://www.talcoelectronics.com/productdetail.asp?id=205-090).
Print out from Talco Electronic website (http://www.talcoelectronics.com/productdetail.asp?id=205-090), Jun. 9, 2006.

* cited by examiner

*Primary Examiner*—William H. Mayo, III
(74) *Attorney, Agent, or Firm*—Blank Rome LLP

(57) ABSTRACT

The present invention relates to a coaxial cable having a flat portion, so that the cable can be used, for example, as a jumper cable that passes through a window sill or a door. Because the cable is flat, it can easily pass through a crack in the door or window without requiring holes to be dilled into the building structure. The flat portion of the cable contains a central conductor that is sequentially surrounded by a substantially flat dielectric, an outer conductor, and a jacket.

27 Claims, 2 Drawing Sheets

COAXIAL CABLE JUMPER DEVICE

FIELD OF THE INVENTION

The present invention is generally related to coaxial cables and, in particular to coaxial cables with a flattened portion.

BACKGROUND OF THE INVENTION

Coaxial cables have long been used to provide a junction between electrical devices. Coaxial cables are usually composed of an elongated central conductor of metal containing a concentrically situated elongated outer tubular conductor of metal, both conductors being separated by a layer of an electrically insulating material. The central conductor may be composed of a single wire or multiple strands of wires.

Coaxial cables are used in many areas such as transmission and computer cables, computer networking, video signal transmission, instrumentation cables, broadcast cables, e.g. TV companies between the community antenna and user homes or businesses, telephone companies, medical e.g. ultrasound devices, and lightweight coaxial cables for satellites. For some of these applications, connection of a device inside a building to another device outside the building or home is required. Because most coaxial cables are round, holes must be drilled in the building structure to pass the cable therethrough to connect the devices.

Moreover, currently available coaxial cables may, in some cases, have deficiencies that limit their usefulness in the outdoor environment. For example, some cables will not sufficiently resist pulling forces and therefore may come apart when pulling forces are applied. Some cables also allow moisture to enter at one end and cause damage to the cable. In some cases, such moisture may also migrate through the cable to the inside of the structure and the components located therein. Additionally, the inventor has found that existing cables often do not provide sufficient electrical performance as well as electromagnetic and/or environmental isolation from the outside.

Therefore, there remains a need for improvements in coaxial cable design, directed toward overcoming one or more of the above deficiencies.

SUMMARY OF THE INVENTION

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

The present invention relates to a coaxial cable that has a flat portion, so that the cable can be used, for example, as a jumper cable that passes through a window sill, a door jam or under a rug. Because the cable is flat, it can easily pass through a space in the door jam or window sill without requiring holes to be drilled into the building structure or in any application where a flat cable jumper may be advantageous to the installed environment. In addition, through its design, the cable provides the electrical performance, the mechanical pull strength and environmental and electromagnetic isolation not available in current state-of-the-art products.

In one embodiment, a central conductor is surrounded by a substantially flat dielectric, an inner laminate tape, a outer metal tape conductor, or an outer conductor consisting of braided, woven or wrapped metallic wires and an outer covering. The inner laminate tape with its bonding layer immediately adjacent to the dielectric core is folded over the underlying dielectric core in a manner to minimize thickness build-up and is preferably heat sealed to the dielectric core. The central conductor of the dielectric core is soldered, or otherwise electrically bonded or attached, to the central conductor of the end connectors. The transition area, where the conductor is attached to the end connector, is then covered with a dielectric shrink tube or wrapped with a dielectric tape material, such as polytetrafluoroethylene (PTFE) or polyethylene (PE). The diameter of the transition area should be approximately the same thickness as the dielectric core. The laminate tape is then electrically bonded to an integral or machined solderable ring part of the end connector to provide stability of the electrical characteristics during flexure. The outer metal tape conductor is sealed along its edges both radially and longitudinally. Each end of the cable preferably has a end connector that includes an integral solderable metallic ring or a separate machined, solderable, metallic ring. The outer metal tape conductor may then be soldered and sealed to the solderable ring. This soldering and sealing of the outer metal tape to the integral or machined metallic ring provides the mechanical pull strength and environmental and electromagnetic isolation not available in current state-of-the-art products.

An adhesive or bonding material may be applied over the outer metal tape to bond the core to the outer jacket to improve the flexure performance of the jumper. A heat shrink tube may then be applied over the outer metal tape including the solderable ring. The heat shrink tubing may be, but is not limited to, PE, polyvinylchloride (PVC), polyvinylidene fluoride (PVDF), polyurethane (PU), PTFE, or other heat shrinkable or extrudeable jacket materials. Crimpable clamps may be used to further secure the jacket material to the core. On the outer jacket, an adhesive agent may be applied to allow for adhesion to surfaces where such an attribute is advantageous to the installation environment.

In another embodiment of the invention, the cable includes an alternate type connector ("F", BNC, RCA, etc.) on at least one end of the cable and a direct connection to a device on the other end of the cable. The alternate type connector may be male or female and the cable may be flat for its entire length or flat for only a portion of its length with the remainder being round with a braided or other type of outer conductor that provides increased flexibility.

In another embodiment of the invention, the cable is a short jumper cable connected on each end to other cables coming from each device. In this embodiment, the entire length of the cable is flat and having connectors on each end of the cable.

In another embodiment, the cable is of sufficient length such that the cable directly connects the external and internal devices. In this embodiment, the cable is flat for the entire length and has connectors on both ends.

In another embodiment, the cable includes connectors on each end such that the cable connects directly to both devices but only the portion of the cable that passes under the window sill or door jam is flat and the rest of the cable is substantially round, with a braided, served or other type of outer conductor that provides increased flexibility.

The features and advantages of the invention will be made apparent by the written description, the claims, and the accompanying drawings or may be learned by practicing the invention.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings like reference numerals designate corresponding parts throughout the several views.

DETAILED DESCRIPTION OF THE PREFERRED EMBODIMENTS

This disclosure provides and discloses exemplary embodiments. In particular, the specification discloses one or more embodiments that incorporate the features of the invention. The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, persons skilled in the art may effect such feature, structure, or characteristic in connection with other embodiments whether or not explicitly described.

Figure 1:
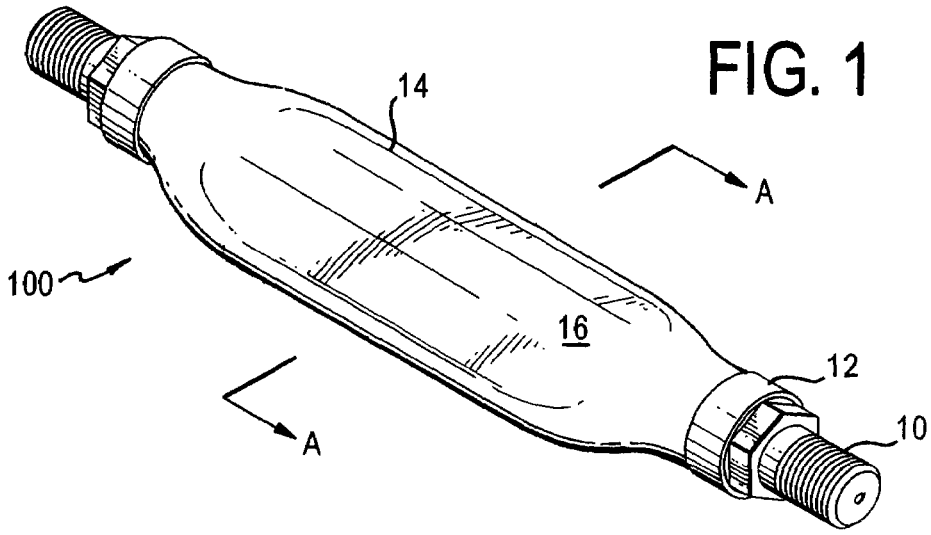
FIG. 1 shows a plan view of the cable.

FIG. 1 shows an embodiment of the present invention. The cable (100) generally contains two ends and a middle portion (16). The ends are preferably terminated with connectors (10) (male or female) to allow for electrical connection of the cable (100) to an electrical device(s). At least a part of the middle portion (16) is substantially flat. "Substantially flat" as used herein refers to the fact that the cable has a relatively broad surface in relation to its thickness. The flat portion of the cable can be the entire length of the cable (except the ends where connectors and/or electrical devices are attached) or a portion of the cable.

Figure 2:
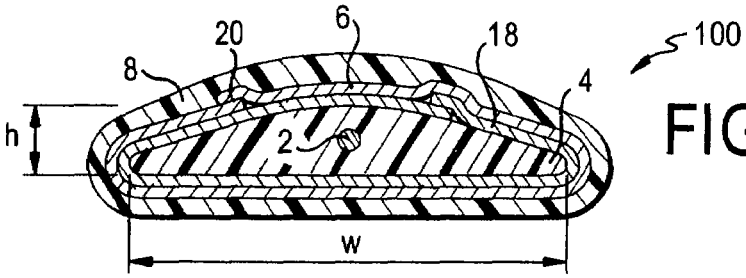
FIG. 2 shows a cross section of the cable at plane A-A.

FIG. 2 shows a cross-sectional view of the cable at the A-A plane. The cable contains several successive layers. The center conductor (2) is located at the core of the cable. While copper, copper-clad aluminum, or copper-clad steel conductor is preferred for the center conductor (2), any type of conductive alloy, solid, hollow, stranded, corrugated or clad will suffice.

Covering the center conductor (2) is a dielectric (4). The dielectric (4) is substantially flat, and preferably, tapers to a point on its lateral sides. The flatness of the dielectric is such that the ratio of the width (w) to the height (h) is in the range of 3:1 to 10:1. Furthermore the height (h) to center conductor diameter ratio is in the range of 4:1 to 6:1. The dielectric can be, but is not limited to taped, solid or foamed polyolefins and fluropolymers.

The dielectric (4) is preferably covered by a bondable, inner tape (18). In a preferred embodiment, the inner tape (18) is formed from copper tape with an adhesive bonding layer, aluminum/polyester/aluminum tape with an adhesive bonding layer, aluminum/polypropylene/aluminum with an adhesive bonding layer, or similar aluminum or bi-metallic (copper clad aluminum, etc.) tapes having an adhesive bonding layer. In any case, the adhesive bonding layer is facing inward and immediately adjacent to the dielectric core. The tape (18) is longitudinally wrapped such that the edges of the inner laminate tape overlap each other along the longitudinal direction of the cable (100) so that the build-up over the dielectric (4) is preferably equal to no more than two times the tape (18) thickness. The bonding agent on the tape can then activated using heat, ultraviolet (UV) light, or other means.

The central conductor of the dielectric core is soldered or otherwise electrically bonded to the central conductor of the end connectors (10). This transition area is then covered with a dielectric shrink tube or wrapped with a dielectric tape material (52), such as polytetrafluoroethylene (PTFE) or polyethylene (PE). The diameter of the dielectric shrink tube or tape wrapped termination area should be approximately the same thickness as the dielectric core.

The metallic portion of the inner tape (18) may be electrically bonded, using a small diameter jumper wire or other means, to the end connectors (10) at the integral or machined solderable ring. Alternatively, the metallic portion of the inner tape (18) may be directly electrically bonded to the end connector at the solderable ring (54).

Figure 3:
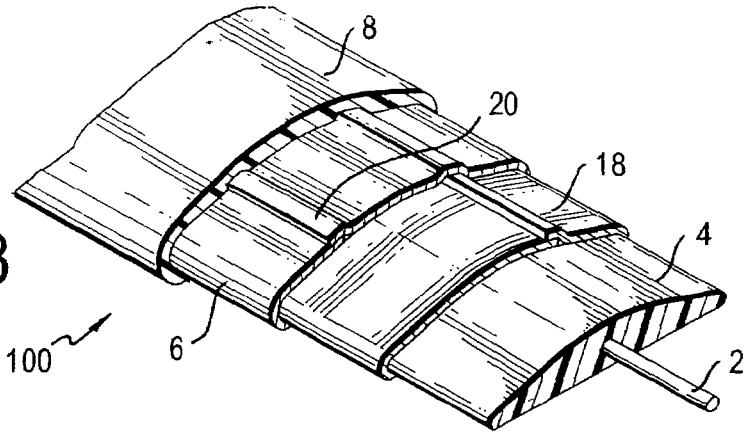
FIG. 3 shows the cable with the layers pealed off.

The inner tape (18) is preferably covered by an outer conductor (6) before a jacket (8) is applied thereon. In a preferred embodiment, the outer conductor (6) is formed from aluminum, copper, bimetallics or the like. Preferably, the outer conductor (6) is a copper, aluminum or bimetallic tape that is longitudinally wrapped such that the edges of the outer conductor (6) overlap each other along the longitudinal direction of the cable (100) and in a region away from the area of maximum thickness, as shown in FIG. 3. In a preferred embodiment, the edges of the outer conductor (6) are soldered together, resulting in a solder line (20) that parallels the longitudinal direction of the cable (100). In this case, the edges can abut and be soldered together, or can overlap and be soldered together. Either way, the process results in the solder line (20) as shown in FIG. 3.

A bonding agent may be applied to the outer surface of the outer conductor or to the inner surface of the jacket to bond the layers together and improve the mechanical performance of the construction in high moisture environments, during flexure, etc.

The jacket (8) can be formed from a variety of non-conductive or semi-conductive compounds typically used to jacket cables. Preferably, a white polyethylene (PE) jacket, which provides both ultraviolet protection and good handling characteristics, is used. As is known to those skilled in the art, the jacket can also be formed from PVC, TEFLON®, PVDF or Kynar®, PU, and other compounds. The jacket may also be colored, color coded and/or printed or striped to identify the cable.

Preferrably, the connection between the connectors and the cable are sealed to prevent moisture from entering the cable. This can be accomplished by sealing the jacket (8) to the connector (10) with a crimpable clamp (12) or injection molded boot. Further, the outer conductor can also be soldered onto the connector at its circumference to seal the dielectric and the inner conductor. Other methods of sealing, including, but not limited to, glue, silicone sealant, flooding compounds, ultrasonic welding, and the like are also appropriate for the present invention.

Figure 4:
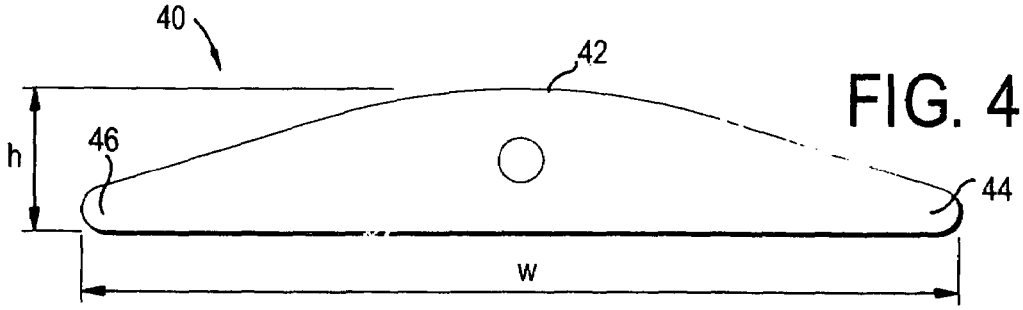
FIG. 4 shows the cross sectional view of the die for extruding the flat dielectric.
Figure 5:
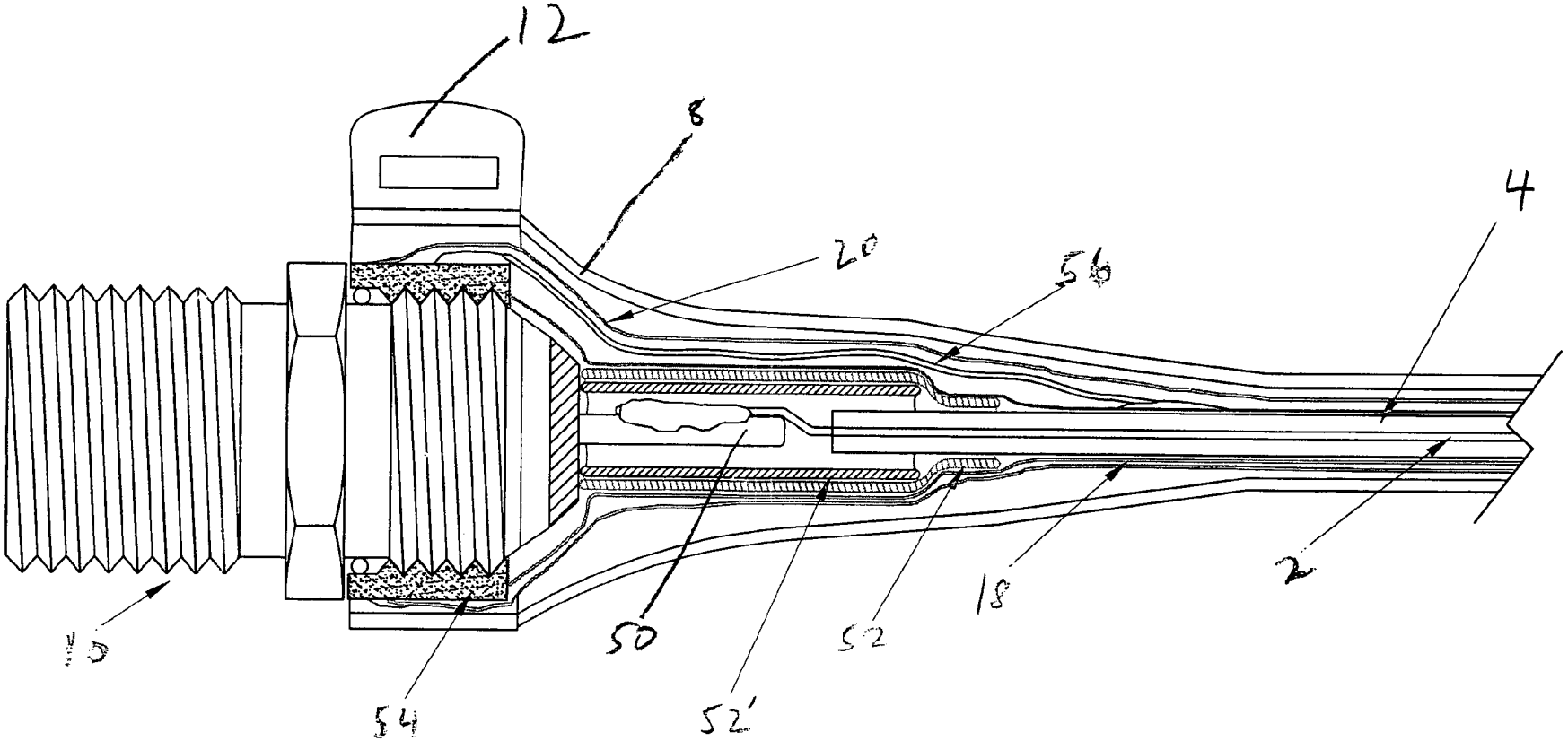
FIG. 5 shows a cross section of the cable along the longitudinal direction at the transition area.

The cable of the present invention is made by extruding a substantially flat dielectric (4) over the center conductor (2), preferably using an extrusion die depicted in FIG. 4. The die (40) is generally triangular having a height (h) and the legs sloping downward to the base. The corners (42, 44, 46) of the die (40) are preferably rounded to eliminate sharp edges. The center conductor (2) locates at the center of the die (40). The flatness of the dielectric (4) is such that the ratio of the width (w) to the height (h) is in the range of 3:1 to 10:1, preferably 5:1 to 9:1, and most preferably 7:1 to 9:1. An inner laminate tape (18) is folded over the underlying dielectric core in a manner to minimize thickness build-up and heat sealed to the dielectric core. The center conductor (2) of the dielectric core is soldered or otherwise electrically bonded to the central conductor (50) of the end connectors (10) as shown in FIG. 5. This transition area, where the connector (10) connects to the cable, is then covered with a dielectric shrink tube(s) or wrapped with a dielectric tape material (52), such as PTFE and PE. This shrink tube may be a double layer wrap as shown in FIG. 5 (52, 52'). The diameter of the dielectric shrink tube(s) or tape (52, 52') wrapped termination area should be approximately the same thickness as the dielectric core (4). The laminate tape (18) is then electrically bonded to an integral or machined solderable ring (54) of the end connector (10) to provide stability of the electrical characteristics during flexure. In one embodiment, the laminate tape (18) may be electrically connected to the solderable ring (54) via a wire (56) which is soldered at one end to the solderable ring (54) and the other end to the laminate tape (18). Alternatively, laminate tape (18) may be directly electrically connected to the solder ring, as shown in FIG. 5.

An outer conductor (6) is then wrapped over the inner tape (18), preferably in a longitudinally wrap, and electrically connected to the solderable ring (54). A jacket (8) is then used to cover the second conductor (6). In a preferred embodiment, the jacket (8) can be placed around the outer periphery of the second conductor (6) in a uniform thickness by heat shrink tubing, an extruder, or the like. A crimpable clamp (12) is then placed over the jacket (8) around the circumference of the solder ring (54). In a preferred embodiment, the ends of the cable are terminated with connectors (10) for establishing electrical connection to electrical devices or other cables.

The flat part of the present invention is most preferably used as a jumper cable that easily passes through small openings in a window sill or door jam due to its flat profile. This cable is most useful in connecting electrical devices inside a building to one outside or from one room to another room. Generally, the flat portion of the cable (is short, preferably about 2-12 in., more preferably about 5-8 in., and most preferably about 6-7 in.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A coaxial cable comprising:

a center conductor concentrically surrounded by a dielectric, such that at least a portion of the dielectric is substantially flat;

an outer conductor surrounding at least the dielectric; a jacket covering the outer conductor; and a connector connected to each end of the cable, wherein the cable connects to the connector by electrically connecting the center conductor with a center conductor of the connector and electrically connecting the outer conductor to a ring on the connector by directly connecting the outer conductor to the ring or by connecting the outer conductor to the ring via a wire.

2. The coaxial cable of claim 1, further comprising a ring clamp attached to each connector to seal the jacket to the connector.

3. The coaxial cable of claim 1, wherein the outer conductor is sealed circumferentially and longitudinally.

4. The coaxial cable of claim 1, wherein the outer conductor is a metal tape.

5. The coaxial cable of claim 4, wherein the metal is copper or aluminum.

6. The coaxial cable of claim 1, wherein the outer conductor is longitudinally wrapped around the dielectric.

7. The coaxial cable of claim 1, wherein the center conductor is copper, copper-clad aluminum, or copper-clad steel.

8. The coaxial cable of claim 1, wherein the metal tape conductor is copper or aluminum.

9. The coaxial cable of claim 1, wherein the connector is secured to the cable with a clamp.

10. The coaxial cable of claim 1, wherein a transition area where the connector connects to the cable is wrapped with a dielectric tape or a heat shrink polymer.

11. The coaxial cable of claim 10, wherein the transition area is approximately equal in impedance to the adjacent dielectric core and connector.

12. A method for connecting two electrical devices comprising the steps of providing a first electrical device;

providing a second electrical device; and electrically connecting the first and second electrical devices with the cable of claim 1.

13. The method of claim 12, further comprising a clamp attached to each connector to seal the jacket to the connector.

14. The method of claim 12, wherein the outer conductor is sealed radially and longitudinally.

15. The method of claim 12, wherein the outer conductor is a metal tape.

16. The method of claim 12, wherein the metal is copper or aluminum.

17. The method of claim 12, wherein the outer conductor is longitudinally wrapped around the dielectric.

18. The method of claim 12, wherein the center conductor is copper, copper-clad aluminum, or copper-clad steel.

19. The method of claim 12, wherein the metal tape conductor is copper or aluminum.

20. A method for making a coaxial cable comprising the steps of providing a center conductor;

surrounding the center conductor with a dielectric, wherein at least a portion of the dielectric is substantially flat;

surrounding the dielectric with an outer conductor;

surrounding the outer conductor with a jacket; and providing a connector at each end of the cable, wherein the center conductor electrically connects with a center conductor of the connector and the outer conductor electrically connects to a ring on the connector by directly connecting the outer conductor to the ring or by connecting the outer conductor to the ring via a wire.

21. The method of claim 20, further comprising a step of attaching a ring clamp to each connector to seal the jacket to the connector.

22. The method of claim 20, wherein the outer conductor is sealed circumferentially and longitudinally.

23. The method of claim 20, wherein the outer conductor is a metal tape.

24. The method of claim 23, wherein the metal is copper or aluminum.

25. The method of claim 20, wherein the outer conductor is longitudinally wrapped around the dielectric.

26. The method of claim 20, wherein the center conductor is copper, copper-clad aluminum, or copper-clad steel.

27. The method of claim 20, wherein the metal tape conductor is copper or aluminum.

* * * * *